US011213445B2

(12) United States Patent
Grindstaff

(10) Patent No.: US 11,213,445 B2
(45) Date of Patent: Jan. 4, 2022

(54) PATIENT POSITIONING DEVICE

(71) Applicant: Rex Allen Grindstaff, Knoxville, TN (US)

(72) Inventor: Rex Allen Grindstaff, Knoxville, TN (US)

( * ) Notice: Subject to any disclaimer, the term of this patent is extended or adjusted under 35 U.S.C. 154(b) by 34 days.

(21) Appl. No.: 16/540,465

(22) Filed: Aug. 14, 2019

(65) Prior Publication Data

US 2020/0093671 A1 Mar. 26, 2020

Related U.S. Application Data

(60) Provisional application No. 62/718,787, filed on Aug. 14, 2018.

(51) Int. Cl.
*A61G 7/05* (2006.01)
*A61G 7/075* (2006.01)

(52) U.S. Cl.
CPC ..... *A61G 7/0526* (2013.01); *A61G 7/0522* (2016.11); *A61G 7/0507* (2013.01); *A61G 7/0525* (2013.01); *A61G 7/075* (2013.01)

(58) Field of Classification Search
CPC .... A61G 1/044; A61G 7/0507; A61G 7/0525; A61G 7/0522; A61G 7/0526; A61G 7/075; A61G 7/0755; A61F 5/37; A47C 20/023
See application file for complete search history.

(56) References Cited

U.S. PATENT DOCUMENTS 3,389,702 A * 6/1968 Kennedy ..... A61B 17/42 606/119
3,939,829 A * 2/1976 Spann ..... A61F 5/3761 128/878
4,321,917 A * 3/1982 Campbell ..... A61G 7/05 128/200.24
4,583,725 A * 4/1986 Arnold ..... A61G 13/12 5/621
5,281,001 A * 1/1994 Bergsten ..... A47C 1/03 297/411.24
5,390,383 A * 2/1995 Carn ..... A61G 13/12 128/877
5,484,393 A * 1/1996 McCoy ..... A61F 5/02 5/621
5,575,027 A * 11/1996 Mueller ..... A61G 7/07 128/845

(Continued)

*Primary Examiner* — Peter M. Cuomo
*Assistant Examiner* — Rahib T Zaman
(74) *Attorney, Agent, or Firm* — Pitts & Lake, P.C.

(57) ABSTRACT

A patient positioning device including a pivot rod configured with a first portion extending in a first direction, and a second portion extending in a second direction substantially laterally from a top end of the first portion, a clamp portion configured to be coupled to a portion of a medical bed, and having a receiving portion configured to receive and clamp the first portion of the pivot rod in place such that the pivot rod is adjustable along and about an axis of the first direction when not clamped, and a swivel plate coupled to a distal end of the second portion of the pivot rod and configured such that the swivel plate is rotatable about another axis offset from, and substantially parallel to, the axis of the first direction, wherein the swivel plate is configured to provide support to maintain a patient in a desired position.

18 Claims, 3 Drawing Sheets

(56) References Cited

U.S. PATENT DOCUMENTS 6,108,841 A * 8/2000 Cameron ..... A61G 13/0009 5/624
6,298,507 B1 * 10/2001 Clyburn ..... A61G 13/12 248/445
6,311,349 B1 * 11/2001 Kazakia ..... A61G 13/12 128/845
6,622,324 B2 * 9/2003 VanSteenburg ..... A61G 13/04 128/845
6,629,944 B2 * 10/2003 Smart ..... A61F 5/04 128/845
6,820,621 B2 * 11/2004 DeMayo ..... A61G 13/12 128/845
7,832,035 B2 * 11/2010 Walczyk ..... A61G 13/12 5/648
8,256,047 B2 * 9/2012 Klemm ..... A47C 16/00 5/621
8,302,228 B2 * 11/2012 Aboujaoude ..... A61G 13/1245 5/648
8,656,536 B1 * 2/2014 Sorg ..... A61G 13/122 5/601
8,782,832 B2 * 7/2014 Blyakher ..... A61B 6/0421 5/601
9,554,959 B2 * 1/2017 Carn ..... A61G 13/123
10,105,274 B2 * 10/2018 Carn ..... A47C 20/021
2005/0091749 A1 * 5/2005 Humbles ..... A61G 13/1235 5/646
2006/0225215 A1 * 10/2006 Krecow ..... A61G 13/12 5/649
2007/0089239 A1 * 4/2007 Whiteside ..... A61G 13/12 5/624
2008/0034502 A1 * 2/2008 Copeland ..... A61G 13/12 5/621
2010/0018537 A1 * 1/2010 Soto ..... A61G 13/12 128/845
2019/0201258 A1 * 7/2019 Di Lauro ..... A61G 13/101

* cited by examiner

PATIENT POSITIONING DEVICE

CROSS-REFERENCE TO RELATED APPLICATIONS

This application claims the benefit of U.S. Provisional Patent Application Ser. No. 62/718,787, filed on Aug. 14, 2018, which is incorporated herein in its entirety by reference.

FIELD OF INVENTION

The present general inventive concept relates to a device for positioning a patient on a medical bed, and, more particularly, to device having a patient support member that is rotatable in two planes to accommodate multiple sizes and positions of patients.

BACKGROUND

Conventional patient positioning devices exist that may be attached to a medical bed and contact a portion of a patient's body to hold the patient in a desired position during a medical procedure. Thus, the conventional device may include a clamp portion that attaches to the medical bed and claims the remaining components of the device, such as the patient contacting portion, in place. However, while height and angular position of the positioning device may be adjusted by moving the portion clamped to the bed, and by moving the portion of the conventional device held by the clamp, the patient contacting portion of the device is still fixed to being moved relative to the clamp before the clamp is secured. This leaves much to be desired, as the fixed nature of the patient contacting portion of the conventional device is not accommodating many different sizes and shapes of the patient, or to any easy adjusting of position that may be desired for the patient after the initial positioning. Therefore, it may be desirable to have a patient positioning device that offered more positioning capability than the fixed patient contacting portion of the conventional device.

BRIEF SUMMARY

According to various example embodiments of the present general inventive concept, a patient positioning device is provided in which portions of the device are rotatable about two different axes.

Additional aspects and advantages of the present general inventive concept will be set forth in part in the description which follows, and, in part, will be obvious from the description, or may be learned by practice of the present general inventive concept.

The foregoing and/or other aspects and advantages of the present general inventive concept may be achieved by providing a patient positioning device including a pivot rod configured with a first portion extending in a first direction, and a second portion extending in a second direction substantially laterally from a top end of the first portion, a clamp portion configured to be coupled to a portion of a medical bed, and having a receiving portion configured to receive and clamp the first portion of the pivot rod in place such that the pivot rod is adjustable along and about an axis of the first direction when not clamped, and a swivel plate coupled to a distal end of the second portion of the pivot rod and configured such that the swivel plate is rotatable about another axis offset from, and substantially parallel to, the axis of the first direction, wherein the swivel plate is configured to provide support to maintain a patient in a desired position.

Other features and aspects may be apparent from the following detailed description, the drawings, and the claims.

BRIEF DESCRIPTION OF THE FIGURES

The following example embodiments are representative of example techniques and structures designed to carry out the objects of the present general inventive concept, but the present general inventive concept is not limited to these example embodiments. In the accompanying drawings and illustrations, the sizes and relative sizes, shapes, and qualities of lines, entities, and regions may be exaggerated for clarity. A wide variety of additional embodiments will be more readily understood and appreciated through the following detailed description of the example embodiments, with reference to the accompanying drawings in which.

DETAILED DESCRIPTION

Figure 1:
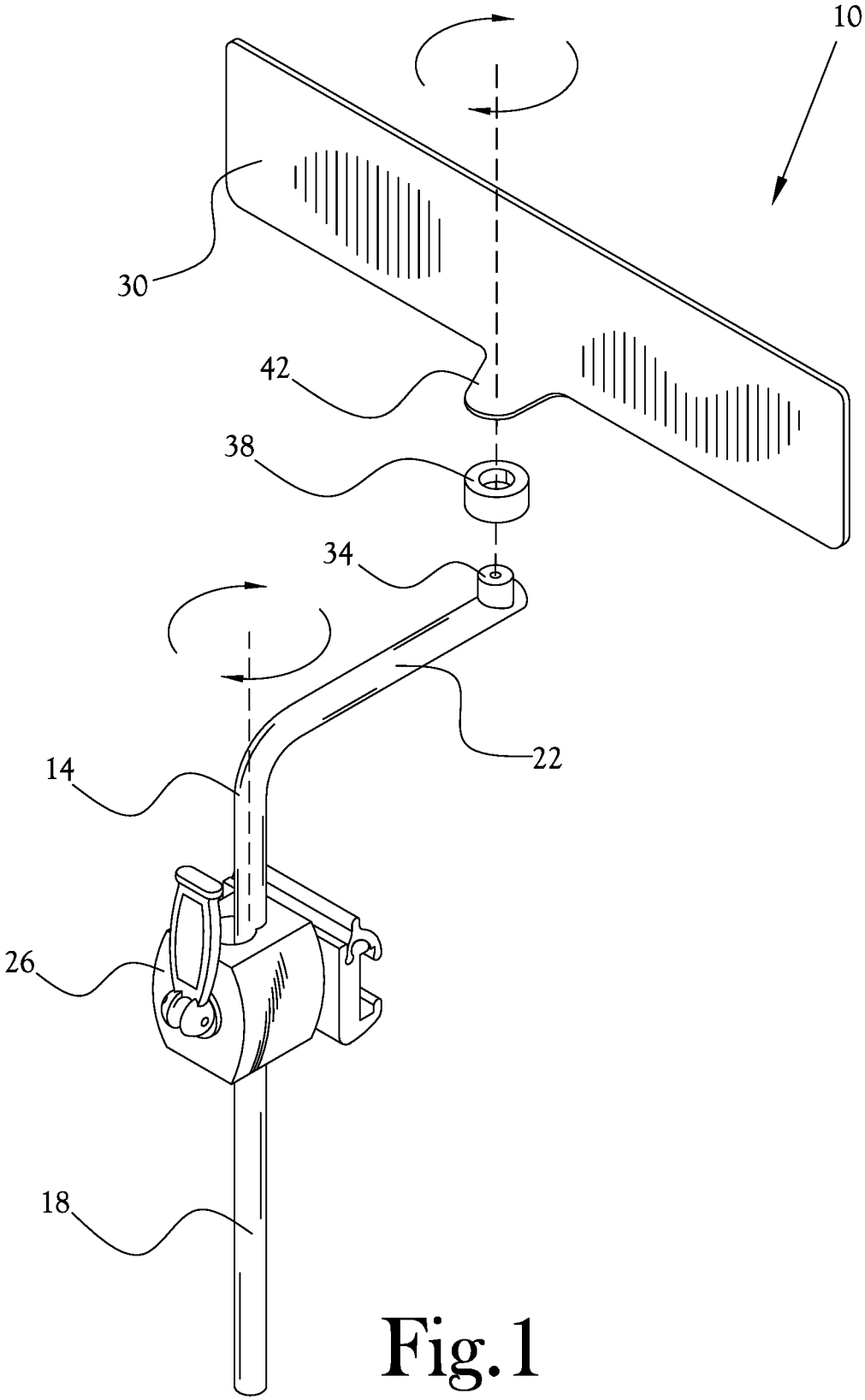
FIG. 1 illustrates an exploded view of a patient positioning device according to an example embodiment of the present general inventive concept.

Reference will now be made to the example embodiments of the present general inventive concept, examples of which are illustrated in the accompanying drawings and illustrations. The example embodiments are described herein in order to explain the present general inventive concept by referring to the figures.

The following detailed description is provided to assist the reader in gaining a comprehensive understanding of the structures and fabrication techniques described herein. Accordingly, various changes, modification, and equivalents of the structures and fabrication techniques described herein will be suggested to those of ordinary skill in the art. The progression of fabrication operations described are merely examples, however, and the sequence type of operations is not limited to that set forth herein and may be changed as is known in the art, with the exception of operations necessarily occurring in a certain order. Also, description of well-known functions and constructions may be simplified and/or omitted for increased clarity and conciseness.

Note that spatially relative terms, such as "up," "down," "right," "left," "beneath," "below," "lower," "above," "upper" and the like, may be used herein for ease of description to describe one element or feature's relationship to another element(s) or feature(s) as illustrated in the figures. Spatially relative terms are intended to encompass different orientations of the device in use or operation in addition to the orientation depicted in the figures. For example, if the device in the figures is turned over or rotated, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

According to various example embodiments of the present general inventive concept, a patient positioning device is provided in which portions of the device are rotatable about two different axes. More particularly, various example embodiments of the present general inventive concept provide a patient contacting portion of the device is rotatable about an axis that is offset from another axis of rotation of the overall device, to provide additional positioning options and comfort for various sizes and shapes of patients than that provided by conventional patient positioning devices. The patient positioning devices described herein are sometimes referred to as arm securement devices, and may act as patient positioners that hold the patient's arms in a non-tucked position for surgery or other medical procedures. The patient positioning device of the present general inventive concept attaches to a medical bed and allows for securement of any arm size at most any desired point. The device may be made of steel, aluminum, plastic, carbon fiber, or any combination thereof, and may have a crossed linked base with a soft foam overlayment to support and protect patients' arms and body for many surgical/medical procedures. While such devices are generally described herein as being securable to a medical bed, it is understood that the term medical bed generically refers a variety of medical support platforms such as a surgical table, examination table, recovery bed, medical bed, etc., that are used for surgical procedures.

FIG. 1 illustrates an exploded view of a patient positioning device according to an example embodiment of the present general inventive concept. In the example embodiment illustrated in FIG. 1, the patient positioning device 10 includes a pivot rod 14 that may be secured in a desired position by a clamping portion 26. The clamping portion 26, which may be configured as a conventional clamp for a medical bed frame, bed rail, and so on, allows the pivot rod 14 to be adjustable in up and down directions as well as being rotated about the axis of the pivot rod 14. In this and other example embodiments, "up" and "down" simply mean back and forth along an axis of the portion of the pivot rod 14 held by the clamping portion 26 of the patient positioning device 10. The pivot rod 14 includes a first portion 18 that extends along the axis on which the pivot rod 14 is adjustable, and a second portion 22 that bends away from the "top" end of the first portion 18 of the pivot rod 14 to extend substantially laterally away from the axis of the first portion 18. As used here and elsewhere in these descriptions, the term "substantially" is used to indicate that the component does not have to extend strictly laterally so as to be perpendicular, or to be strictly parallel, etc., but is generally within an acceptable engineering range such that the component can perform its intended function. Thus, adjusting the position of the pivot rod 14 along the axis of the first portion 18, and rotating the pivot rod 14 about that axis, allows a user to place a distal end of the second portion 22 of the pivot rod 14 proximate to the area of the patient, typically the arm, that is to be contacted and braced. A swivel plate 30 is coupled to the distal end of the second portion 22 of the pivot rod 14 such that the swivel plate 30 is rotatable around an axis extending upward from the distal lend of the second portion 22. Thus, the swivel plate 30 is able to rotate about an axis that is offset from, and substantially parallel to, the axis of the first portion 18 of the pivot rod 14. In various example embodiments the swivel plate 30, as well as other components of the patient positioning device 10, may be formed of steel, aluminum, plastic, carbon fiber, etc., or combinations of two or more of these materials. In the example embodiment illustrated in FIG. 1, a mounting rod portion 34 extends upward, or along the axis of the first portion 18, from proximate the distal end of the second portion 22 of the pivot rod 14, and a mounting lug 38 is configured to be coupled to the mounting rod portion 34 so as to be rotatable about the mounting rod portion 34. An attachment extension 42 extends from approximately midway along the bottom edge of the swivel plate 30, and is attached to the mounting lug 38. In various example embodiments, the swivel plate 30 may be welded to a top surface of the mounting lug 30, so that the swivel plate 30 may be permanently coupled to the pivot rod 14. Thus, even though the pivot rod 14 is fixed in a desired position along and about an axis of the first portion 18 of the pivot rod 14, the swivel plate 30 is still rotatable about the axis extending up from proximate the distal end of the second portion 22 of the pivot rod 14. As such, once the general contact area of the patient is determined, the swivel plate 30 is still able to rotate to accommodate the size and shape of the arm or other body portion of the patient to be braced. In various example embodiments, a fixing portion may be provided to the patient positioning device 10 to hold the swivel plate 30 at the desired rotation. In various example embodiments of the present general inventive concept, the swivel plate may be configured as a rigid plate that extends in directions generally away from the axis extending from the distal end of the second portion 22 of the pivot rod 14. Also, as illustrated in FIG. 1, in various example embodiments the swivel plate may be offset from the axis of the mounting rod portion 34 according to a length of the attachment extension 42, so that the patient is less likely to contact the pivot rod 14 or other portions of the patient positioning device 10 that are not intended to be contacted by the patient.

Figure 2:
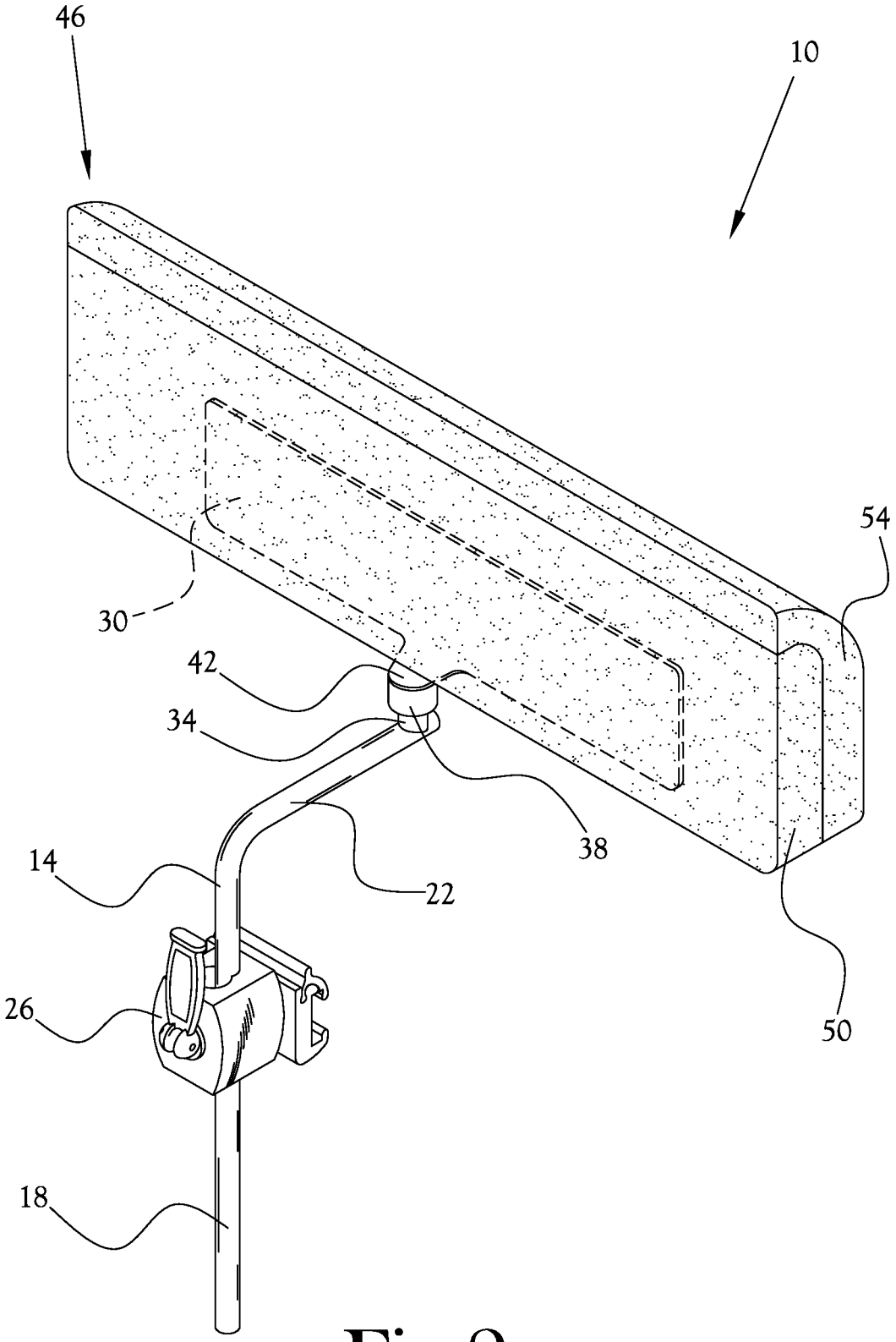
FIG. 2 illustrates an assembled view of the patient positioning device of FIG. 1 with a foam pad overlay according to an example embodiment of the present general inventive concept.

FIG. 2 illustrates an assembled view of the patient positioning device of FIG. 1 with a foam pad overlay according to an example embodiment of the present general inventive concept. As illustrated in FIG. 2, a cushioning pad 46 may be provided over the swivel plate 30 so that the patient has a comfortable surface with which to make contact. In various example embodiments the cushioning pad 46 may be formed of rubber, foam, pillowed cloth, etc., or a combination of two or more of such materials. In various example embodiments the cushioning pad 46 may be reusable, and may be provided with a removable cover for washing or disposal. In various example embodiments the cushioning pad may be disposable after each use. In the example embodiment illustrated in FIG. 2, the cushioning pad 46 is formed of a first foam material 50 that is relatively stiff to more easily maintain the shape and position of the swivel plate 30 when extending away from either end of the swivel plate 30, and a second foam material 54 that is softer than the first foam material 50 so as to provide a more comfortable contact surface for the patient. While the example embodiment illustrated in FIG. 2 shows a cushioning pad that is substantially thicker than the swivel plate 30, and which extends in a substantial direction away from the ends of the swivel plate 30, with a top surface in which the second foam material 54 curves over a top of the first foam material 50, it is understood that a variety of shapes and other configurations of cushioning pads may be employed without departing from the scope of the present general inventive concept.

Figure 3:
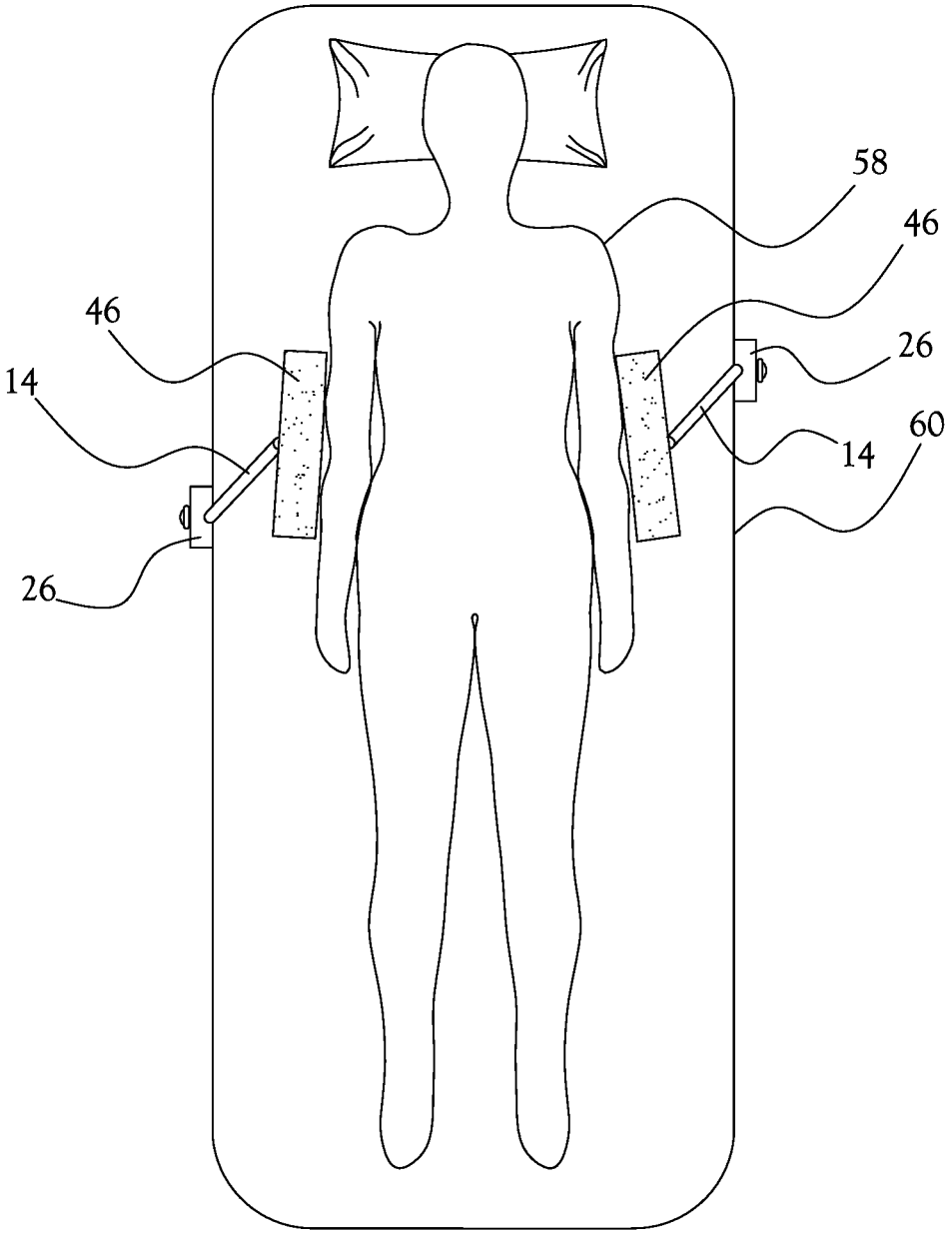
FIG. 3 illustrates a patient secured in a position using two of the patient positioning devices of FIG. 1 according to an example embodiment of the present general inventive concept.

FIG. 3 illustrates a patient secured in a position using two of the patient positioning devices of FIG. 1 according to an example embodiment of the present general inventive concept. As illustrated in FIG. 3, the patient positioning devices 10 may be attached to the medical bed 60, at the frame or bedrail or other portion of the medical bed 60, at various positions of convenience, and the swiveling padded portions are able to rotate around an axis proximate a distal end of the pivot rod 14 to accommodate the arms of the patient, and can even allow small amounts of movement of the patients arms while still bracing the patient substantially in the desired position. As illustrated, example embodiments of the present general inventive concept provide a patient positioner that may hold a patient's arms in a non-tucked position for surgery or other medical procedures. The device can attach to the medical bed or surgical table and allow for securement of any arm size at any point. The device may have a crossed linked base with a soft foam overlayment to support and protect patients' arms and body for a variety of medical procedures. The device may fit a rail device or frame and may rotate 360 degrees at that point of fixation. A disposable static foam pad may be provided to fit over the swivel plate that also rotates 360 degrees to contact a patient at any point to secure the arm or other part of the patient in a lateral position. The device may rotate in two planes, and fit any arm size or shape for securement.

Various example embodiments of the present general inventive concept may provide a patient positioning device including a pivot rod configured with a first portion extending in a first direction, and a second portion extending in a second direction substantially laterally from a top end of the first portion, a clamp portion configured to be coupled to a portion of a medical bed, and having a receiving portion configured to receive and clamp the first portion of the pivot rod in place such that the pivot rod is adjustable along and about an axis of the first direction when not clamped, and a swivel plate coupled to a distal end of the second portion of the pivot rod and configured such that the swivel plate is rotatable about another axis offset from, and substantially parallel to, the axis of the first direction, wherein the swivel plate is configured to provide support to maintain a patient in a desired position. The patient positioning device may further include a cushioning pad configured to be placed around the swivel plate. The cushioning pad may be a foam pad. The cushioning pad may include a first layer configured to slip over the swivel plate, and a second layer configured to be in contact with the patient. The swivel plate may be configured as an elongated substantially flat member that is offset from the another axis offset from the axis of the first direction. The patient positioning device may further include a mounting rod portion extending upward from the distal end of the second portion of the pivot rod, and a mounting lug coupled to the mounting rod portion and configured to be rotatable about the mounting rod portion, wherein the swivel plate is attached to mounting lug. The patient positioning device may further include an attachment extension extending back from a substantially middle portion of a bottom of the swivel plate, the attachment extension being welded to the mounting lug. The swivel plate may be formed of steel, aluminum, plastic, carbon fiber, etc., or a combination of two or more thereof. The swivel plate may be configured to rotate 360 degrees about the another axis offset from the axis of the first direction.

Numerous variations, modifications, and additional embodiments are possible, and accordingly, all such variations, modifications, and embodiments are to be regarded as being within the spirit and scope of the present general inventive concept. For example, regardless of the content of any portion of this application, unless clearly specified to the contrary, there is no requirement for the inclusion in any claim herein or of any application claiming priority hereto of any particular described or illustrated activity or element, any particular sequence of such activities, or any particular interrelationship of such elements. Moreover, any activity can be repeated, any activity can be performed by multiple entities, and/or any element can be duplicated.

It is noted that the simplified diagrams and drawings included in the present application do not illustrate all the various connections and assemblies of the various components, however, those skilled in the art will understand how to implement such connections and assemblies, based on the illustrated components, figures, and descriptions provided herein, using sound engineering judgment. Numerous variations, modification, and additional embodiments are possible, and, accordingly, all such variations, modifications, and embodiments are to be regarded as being within the spirit and scope of the present general inventive concept.

While the present general inventive concept has been illustrated by description of several example embodiments, and while the illustrative embodiments have been described in detail, it is not the intention of the applicant to restrict or in any way limit the scope of the general inventive concept to such descriptions and illustrations. Instead, the descriptions, drawings, and claims herein are to be regarded as illustrative in nature, and not as restrictive, and additional embodiments will readily appear to those skilled in the art upon reading the above description and drawings. Additional modifications will readily appear to those skilled in the art. Accordingly, departures may be made from such details without departing from the spirit or scope of applicant's general inventive concept.

The invention claimed is:

1. A patient positioning device, comprising:

a pivot rod configured with a first portion extending in a first direction, and a second portion extending in a second direction substantially laterally from a top end of the first portion;

a clamp portion configured to be coupled to a portion of a medical bed, and having a receiving portion configured to receive and clamp the first portion of the pivot rod in place such that the pivot rod is adjustable along and about an axis of the first direction when not clamped; and a swivel plate coupled to a distal end of the second portion of the pivot rod and configured such that the swivel plate is offset from, and rotatable about, another axis offset from, and substantially parallel to, the axis of the first direction;

wherein the swivel plate is configured to provide support to maintain a patient in a desired position.

2. The patient positioning device of claim 1, further comprising a cushioning pad configured to be placed around the swivel plate.

3. The patient positioning device of claim 2, wherein the cushioning pad is a foam pad.

4. The patient positioning device of claim 2, wherein the cushioning pad comprises:

a first layer configured to slip over the swivel plate; and a second layer configured to be in contact with the patient.

5. The patient positioning device of claim 1, wherein the swivel plate is configured as an elongated substantially flat member that is offset from the another axis offset from the axis of the first direction.

6. The patient positioning device of claim 1, further comprising:

a mounting rod portion extending upward from the distal end of the second portion of the pivot rod; and a mounting lug coupled to the mounting rod portion and configured to be rotatable about the mounting rod portion;

wherein the swivel plate is attached to mounting lug.

7. The patient positioning device of claim 6, further comprising an attachment extension extending back from a substantially middle portion of a bottom of the swivel plate, the attachment extension being welded to the mounting lug.

8. The patient positioning device of claim 1, wherein the swivel plate comprises steel, aluminum, plastic, carbon fiber, or a combination of two or more thereof.

9. The patient positioning device of claim 1, wherein the swivel plate is configured to rotate 360 degrees about the another axis offset from the axis of the first direction.

10. A patient positioning device, comprising:

a pivot rod configured with a first portion extending in a first direction, and a second portion extending in a second direction substantially laterally from a top end of the first portion;

a clamp portion configured to be coupled to a portion of a medical bed, and having a receiving portion configured to receive and clamp the first portion of the pivot rod in place such that the pivot rod is adjustable along and about an axis of the first direction when not clamped;

a swivel plate coupled to a distal end of the second portion of the pivot rod and configured such that the swivel plate is rotatable about another axis offset from, and substantially parallel to, the axis of the first direction;

a mounting rod portion extending upward from the distal end of the second portion of the pivot rod; and a mounting lug coupled to the mounting rod portion and configured to be rotatable about the mounting rod portion;

wherein the swivel plate is attached to mounting lug; and wherein the swivel plate is configured to provide support to maintain a patient in a desired position.

11. The patient positioning device of claim 10, further comprising a cushioning pad configured to be placed around the swivel plate.

12. The patient positioning device of claim 11, wherein the cushioning pad is a foam pad.

13. The patient positioning device of claim 11, wherein the cushioning pad comprises:

a first layer configured to slip over the swivel plate; and a second layer configured to be in contact with the patient.

14. The patient positioning device of claim 10, wherein the swivel plate is configured as an elongated substantially flat member that is offset from the another axis offset from the axis of the first direction.

15. The patient positioning device of claim 10, further comprising an attachment extension extending back from a substantially middle portion of a bottom of the swivel plate, the attachment extension being welded to the mounting lug.

16. The patient positioning device of claim 10, wherein the swivel plate comprises steel, aluminum, plastic, carbon fiber, or a combination of two or more thereof.

17. The patient positioning device of claim 10, wherein the swivel plate is configured to rotate 360 degrees about the another axis offset from the axis of the first direction.

18. A patient positioning device, comprising:

a pivot rod configured with a first portion extending in a first direction, and a second portion extending in a second direction substantially laterally from a top end of the first portion;

a clamp portion configured to be coupled to a portion of a medical bed, and having a receiving portion configured to receive and clamp the first portion of the pivot rod in place such that the pivot rod is adjustable along and about an axis of the first direction when not clamped;

a swivel plate coupled to a distal end of the second portion of the pivot rod and configured such that the swivel plate is rotatable about another axis offset from, and substantially parallel to, the axis of the first direction; and an attachment extension extending back from a substantially middle portion of a bottom of the swivel plate, the attachment extension being coupled to the distal end of the second portion of the pivot rod;

wherein the swivel plate is configured to provide support to maintain a patient in a desired position.

* * * * *